US005465840A

United States Patent [19]

Joh

[11] Patent Number: 5,465,840

[45] Date of Patent: Nov. 14, 1995

[54] GOLF BAG, AND METHODS OF CONSTRUCTING AND UTILIZING SAME

[76] Inventor: William K. Joh, 6852 Vachon Dr., Bloomfield Hills, Mich. 48301

[21] Appl. No.: 188,463

[22] Filed: Jan. 26, 1994

Related U.S. Application Data

[63] Continuation-in-part of Ser. No. 43,861, Apr. 7, 1993, abandoned.

[51] Int. Cl.[6] ..... A63B 55/00

[52] U.S. Cl. ..... 206/315.6; 206/315.3; 206/315.5

[58] Field of Search ..... 206/315.3, 315.4, 206/315.5, 315.6

[56] References Cited

U.S. PATENT DOCUMENTS

| | | | |
|---|---|---|---|
| 1,227,657 | 5/1917 | Pierce | 206/315.6 |
| 1,726,245 | 8/1929 | Shelton | 206/315.4 |
| 1,918,447 | 7/1933 | Blatz | 206/315.5 |
| 2,860,679 | 11/1958 | Kouke | 206/315.6 |
| 3,503,518 | 3/1970 | Black | 211/70.2 |
| 3,543,355 | 12/1970 | Wyckoff et al. | 24/81 |
| 3,966,051 | 4/1975 | Hollister | 211/14 |
| 4,200,131 | 4/1980 | Chitwood et al. | 150/1.5 R |
| 4,383,563 | 5/1983 | Kirchhoff, Jr. | 150/1.5 R |
| 4,673,082 | 7/1987 | Hemme | 206/315.6 |
| 4,753,344 | 6/1988 | Antonious | 206/315.3 |
| 4,779,725 | 10/1988 | Gerber | 206/315.3 |
| 4,852,896 | 8/1989 | Mills | 280/47.18 |
| 4,915,221 | 4/1990 | Spangler | 206/315.6 |
| 4,960,212 | 10/1990 | Wu | 211/70.2 |
| 4,995,510 | 2/1991 | Fletcher | 206/315.6 |
| 5,029,703 | 7/1991 | Dulyea, Sr. | 206/315.3 |
| 5,060,796 | 10/1991 | Brooks, III | 206/315.6 |
| 5,062,528 | 11/1991 | Whitaker, Jr. | 206/315.5 |
| 5,094,345 | 3/1992 | Yonnetti | 206/315.3 |
| 5,103,974 | 4/1992 | Antonious | 206/315.6 |
| 5,135,107 | 8/1992 | Ingraham | 206/315.6 |
| 5,176,253 | 1/1993 | Perrin et al. | 206/315.3 |
| 5,188,243 | 2/1993 | Ruiz | 206/315.3 |
| 5,222,596 | 6/1993 | Jordan | 206/315.3 |
| 5,226,533 | 7/1993 | Antonious | 206/315.6 |
| 5,279,414 | 1/1994 | Brasher | 206/315.3 |

FOREIGN PATENT DOCUMENTS

| | | | |
|---|---|---|---|
| 8333 | 2/1911 | United Kingdom | 206/315.5 |
| 276276 | 8/1927 | United Kingdom | 206/315.3 |
| 2130102 | 5/1984 | United Kingdom | 206/315.6 |

*Primary Examiner*—Gary E. Elkins

*Attorney, Agent, or Firm*—Weiner, Carrier & Burt; Joseph P. Carrier; Irving M. Weiner

[57] ABSTRACT

According to the invention there is provided apparatus for supporting a plurality of golf clubs which prevents the clubs from coming into damaging contact with each other while the clubs are being transported or stored in the supporting apparatus and which facilitates use and selection of the clubs during a round of golf. The apparatus comprises a holder mechanism having a plurality of separate storage compartments defined therein for receiving a plurality of golf clubs, respectively, each storage compartment isolating a golf club received therein from contact with other golf clubs received in other storage compartments, and each storage compartment having a lower portion for receiving a shaft of one of the golf clubs and an upper portion for receiving a head of the one golf club. Additionally the apparatus comprises a container mechanism for containing and supporting the holder mechanism in multiple, longitudinally separate positions of the holder mechanism, while the holder mechanism is longitudinally and rotatably movable with respect to the container mechanism.

19 Claims, 3 Drawing Sheets

GOLF BAG, AND METHODS OF CONSTRUCTING AND UTILIZING SAME

CROSS-REFERENCES TO RELATED APPLICATIONS

This application is a continuation-in-part of related application serial number U.S. Ser. No. 08/043,861 filed Apr. 7, 1993 abandoned.

BACKGROUND OF THE INVENTION

1. Field of the Invention

The present invention pertains to a novel golf bag construction and methods of making and utilizing same. More particularly, the present invention relates to an economic golf bag construction which securely contains a set of clubs such that the club shafts and heads are prevented from contacting each other and which facilitates use of the clubs during a game.

2. Description of Relevant Art

There arc many known golf bags and many known attachments and inserts for golf bags which are adapted to protect golf clubs from being damaged through contact with other golf clubs in the bag. For example, U.S. Pat. Nos. 2,860,679, 5,094,345, 5,188,243 and 5,222,596 disclose holders which are adapted to be connected to a golf bag for holding golf clubs, and perhaps other golf items as well, in an organized manner within the golf bag. The holder of U.S. Pat. No. 2,860,679 is a rack consisting of a plurality of elongated tubes secured in a spaced relationship to each other by a pair of disks, and which is adapted to be mounted in a golf bag at an intermediate portion thereof so that a plurality of golf club shafts can be inserted into the tubes, respectively. Similarly, the device disclosed in U.S. Pat. No. 5,188,243 is a rack consisting of a plurality of tubes disposed in a spaced relationship to each other by a plurality of disks, although this holder is adapted to be either inserted in a golf bag or used independently of a golf bag. While each of these devices are effective for their intended purpose, golf clubs held thereby are still subjected to being damaged by contact with other clubs because the clubs are free to rotate within the tubes so that the club heads continually contact each other when the holder is being used. The holder disclosed in U.S. Pat. No. 5,222,596 includes an upper retainer portion adapted to releasably secure the shafts of a plurality of golf clubs and a base portion with grooves for receiving the grips of a plurality of golf clubs. Although this holder somewhat better restrains movement of the golf clubs while the holder is being used in comparison to the holders discussed above, but the clubs are still permitted to rotate when secured by this holder so that they may still come into damaging contact with each other.

The device disclosed in U.S. Pat. No. 5,094,345 is an organizing device which is adapted to be secured to the upper end of a golf bag for separately securing the heads of numerous golf irons and golf woods in isolation from each other so as to prevent the golf club heads from being damaged by contact with other heads. The organizing device also includes space for separately storing golf balls, golf tees, scorecards and pencils. Although this organizing device desirably prevents the heads of numerous golf clubs from coming into damaging contact with each other, the device is rather large and bulky, it does not prevent the shafts of the golf clubs from coming into damaging contact with each other, and makes it inconvenient to remove any given golf club from the golf bag for use during a round of play.

Further, U.S. Pat. Nos. 1,918,447 and 5,062,528 disclose known golf bag structures which integrally include devices for securing and storing golf clubs in an organized manner within the golf bag. U.S. Pat. No. 1,918,447 discloses a telescopic golf bag structure having a perforated disk near an upper end thereof for receiving the shafts of clubs therethrough such that the clubs can be disposed within the bag in an organized manner, while a lower section of the bag may be telescopically moved relative to an upper section of the bag between a contracted position in which the golf club heads project outwardly through an upper opening of the bag and an expanded position in which the club heads are disposed below the upper opening of the bag so that a cover may be fitted on the upper opening for enclosing the clubs within the bag. The golf bag of U.S. Pat. No. 5,062,528 includes an organizing disk disposed over an upper end thereof and including a number of openings disposed in a regular matrix pattern for receiving the shafts of a number of golf clubs. Again, both of these known golf bags are disadvantageous because the golf clubs as supported therein are still free to rotate within the bag so that the club heads and shafts may come into damaging contact with each other.

The present invention has been developed to provide a golf bag structure which overcomes the problems and disadvantages of known golf club holders used with or as part of a golf bag, and to generally fulfill a need in the art for a golf bag structure which provides a high degree of protection for golf clubs within a golf bag, permits efficient utilization of entire space within the golf bag, and yet is economic to manufacture and convenient to use.

SUMMARY OF THE INVENTION

According to the present invention there is provided an apparatus for supporting golf clubs, comprising holder means having a plurality of separate storage compartments defined therein for receiving a plurality of golf clubs, respectively, each storage compartment isolating a golf club received therein from contact with other golf clubs received in other storage compartments, and each storage compartment having a lower portion for receiving a shaft of one of the golf clubs and an upper portion for receiving a head of the one golf club; and container means for containing and supporting the holder means in multiple, longitudinally separate positions of the holder means, the holder means being movable with respect to the container means.

Preferably the holder means will be molded as an integral unitary member from plastic, the storage compartments will be arranged in a spaced manner about an outer circumferential portion of the holder means and have openings defined in radially outer surfaces of upper ends thereof such that a club head will hang on the upper portion of its corresponding storage compartment when the holder means is in a raised, longitudinally extended position thereof.

Preferably the holder means will be specifically adapted and shaped to receive iron type golf clubs, while the apparatus will further preferably include another receptacle disposed inwardly of the storage compartments for receiving the shafts of a plurality of wood type golf clubs therein, and retainer means associated with the receptacle for selectively securing the wood type golf clubs within the receptacle. The receptacle will preferably cooperate with the holder means to define internal surfaces of the storage compartments, will preferably project above the holder means, and the holder means will preferably be movable with respect to the receptacle and may be telescopically adjustable in length.

Still further, the apparatus will preferably comprise an outer, decorative bag and means for selectively fastening the container means within the decorative bag; a club head washer unit selectively securable to the container means in a space between the holder means and the outer decorative bag; a closable pocket defined in the outer bag which is adapted to receive the club head washer therethrough; and an auxiliary club storage receptacle provided on an outer surface of the outer bag for receiving and temporarily storing a golf club.

It is an object of the present invention to provide apparatus for supporting a plurality of golf clubs which prevents the clubs from coming into damaging contact with each other while the clubs are being transported and/or stored in the supporting apparatus, to thereby avoid damage to the golf clubs and to prevent the annoying rattling noises which would occur if the clubs were permitted to come into contact with each other.

Another object of the invention is to provide such an apparatus which facilitates selection and use of various golf clubs during a round of golf.

Yet another object of the invention is to provide such an apparatus which is simple in structure and economical to manufacture.

Still another object of the invention is to provide such an apparatus which permits enhanced care of golf clubs during use, storage and transportation.

A still further object of the invention is to provide such an apparatus which is compact and lightweight.

Other objects, advantages and salient features of the invention will become apparent from the following detailed description which, when taken into conjunction with the annexed drawings, discloses preferred embodiments of the present invention.

DETAILED DESCRIPTION OF THE PREFERRED EMBODIMENTS

Figure 1:
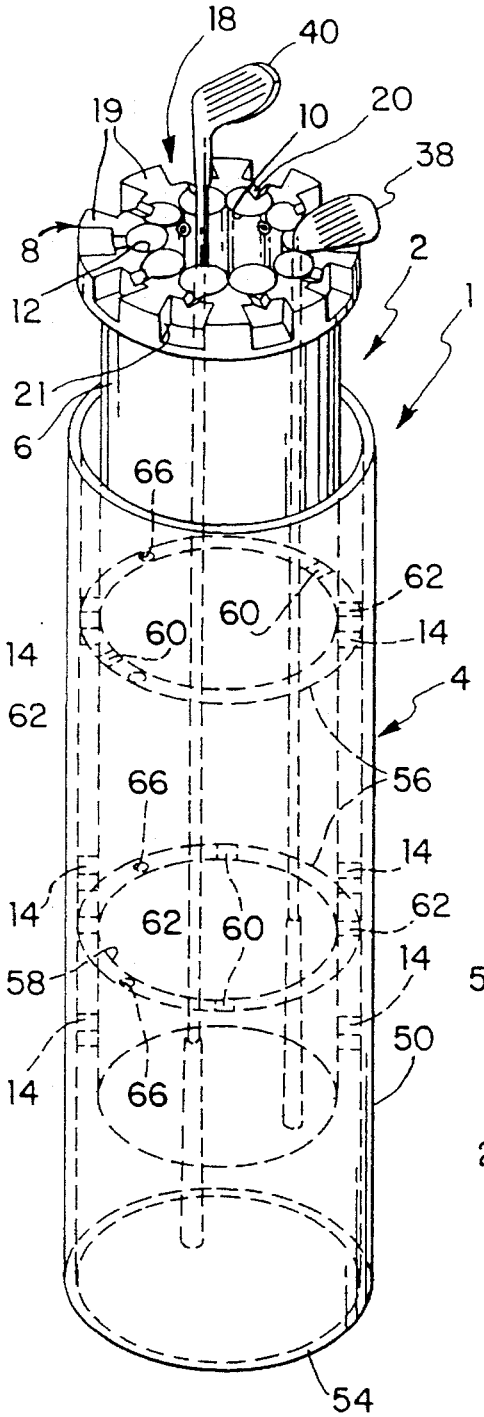
FIG. 1 is a front perspective view of a first preferred embodiment of the invention, the view being partially exploded and including broken lines to show internal cooperating structure between components.
Figure 2:
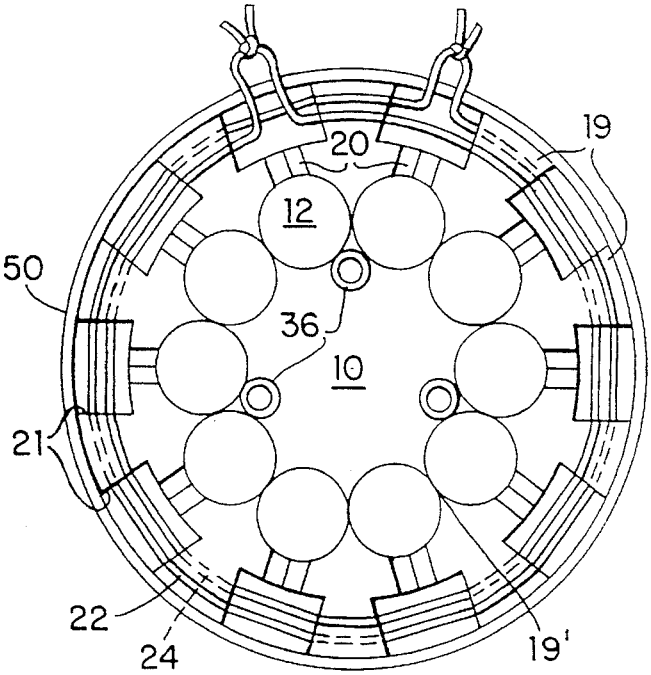
FIG. 2 is a top plan view of FIG. 1.

Referring to FIGS. 1 and 2, there is shown a first preferred embodiment of a golf club supporting structure according to the present invention. The structure generally indicated at 1 comprises two principal parts, a holder means 2 and a container means 4. The holder means 2 is preferably formed as an integral unitary member which is substantially cylindrically shaped, including a lower portion 6 which is an elongate cylindrical body and an upper portion 8 provided at the upper end of the lower portion 6 and projecting outwardly therefrom.

The lower portion 6 has a large central opening 10 defined longitudinally through the center thereof, and a plurality of smaller longitudinal openings 12 (ten of the openings 12 are shown in the drawing figures) which are also defined completely through the longitudinal length of the lower portion 6 and are disposed in an outer circumferential portion of the lower portion 6 completely surrounding the inner central opening 10. The openings 10, 12 are open at both ends thereof, each of the smaller openings 12 being adapted to receive the shaft of an iron type golf club 38 therein, and the larger central opening 10 being adapted to receive the shafts of a plurality of wood type golf clubs 40 therein. The lower portion 6 also has at least one pair of handles 14 formed on an outer circumferential surface thereof as part of a means for permitting the holder means 2 to be supported in multiple, longitudinally separate positions by the container means 4, as discussed further below.

The upper portion 8 of the holder means 2 includes extensions of the openings 10, 12, and also includes a deck 18 which projects outwardly of the openings 12. The deck 18 includes a plurality of septa 19 which are retaining members disposed between adjacent pairs of the smaller openings 12, smaller slots or recesses 20 defined between adjacent pairs of the septa 19 and extending outwardly from upper ends of the smaller openings 12, respectively, and larger recesses or U-gaps 21 defined in outer surfaces of the deck 18 outwardly of the slots 20, respectively.

The upper and lower portions 6, 8 of the holder means 2 are preferably formed as an integral unitary member, as discussed above. For example the holder means may be economically formed as a unitary member by being molded from foamed plastics or the like. Alternatively, the deck 18 could be formed separately from the lower portion 6 and secured thereto. Together the openings 12 in the lower portion 6, and the openings 12, slots 20, septa 19 and U-gaps 21 of the upper portion 8 define a plurality of storage compartments for a plurality of golf clubs.

Figure 3:
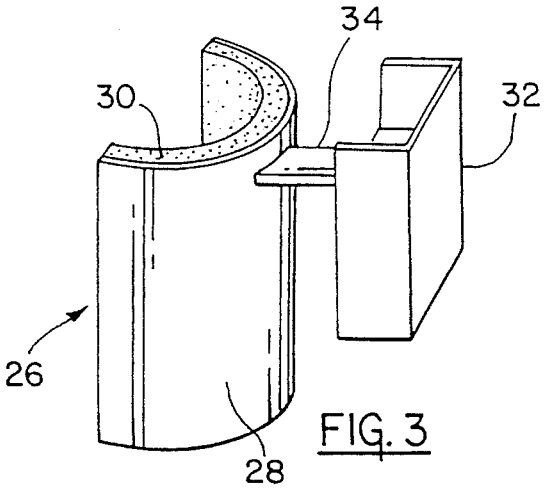
FIG. 3 is a perspective view of a pad member which cooperates with the embodiment of FIG. 1.

The holder means 2 also preferably includes a pair of elastic bands 22, 24 which are shown in FIG. 2 but omitted from FIG. 1 for ease of understanding, the loops 22, 24 are snugly tied interweavingly and are arranged so as to pass around the septa 19 alternately such that one of the loops 22 or 24 engages a lower surface of one septum and upper surfaces of the two septa adjacent thereto, while the other loop 22 or 24 engages the upper surface of the one septum and engages the lower surfaces of the two adjacent septa as shown in FIG. 2. The bands 22, 24 are preferably adjustable in length by any appropriate means such as a knot tied in loose ends thereof or a clip securing the loose ends thereof together. Additionally, the apparatus will preferably include a plurality of head pads 26 as shown in FIG. 3, each of which comprises a hard shell member 28 formed of plastic, aluminum or the like and a padding layer 30 of a spongelike material such as foam rubber fixed to an inner concave surface of the shell 28. As will be understood, the head pads 26 are shaped complementary to the U-gaps 21, the slots 20 and the smaller openings 12 such that a projecting outer portion 32 of a shell member is shaped to fit into a U-gap 21, an intermediate section 34 of a shell member is shaped to fit in a slot 20 and the inner concave portion of the shell member 28 supporting the sponge layer 30 is shaped to fit within the upper end of one of the openings 12.

As shown in FIGS. 1 and 2 a plurality of ring-like hooks 36 are fixed to an inner surface of the central larger opening 10 near an upper end thereof. An adjustable length elastic cord, not shown but similar to the bands 22, 24, may be passed through the hooks 36 for additionally securing the wood type golf clubs 40 disposed in the central opening 10. During use of the golf clubs while playing a game of golf, head covers for the wood type golf clubs would be removed therefrom and the elastic cord would be loosened so that it does not obstruct removal or insertion of the wood type golf club shafts into the central opening 10; and for storage purposes the covers for the club heads would be inserted thereover and the elastic cord would be tied or otherwise secured about the open ends of the head covers to maintain the covers and the club heads securely in position. The apparatus may also optionally include padded or clothed tubes (not shown) which would be insertable in the central opening 10 and adapted to receive the shafts of the wood type golf clubs also inserted into the central opening 10.

In use of the holder means 2 the shafts of a plurality of iron type golf clubs 38 would be inserted into the smaller openings 12, respectively, such that the heads of the clubs 38 would rest on the slots 20 and project outwardly into the U-gaps 21, with each iron head engaged and/or restrained between a pair of septa 19, while the shafts of a plurality of wood type golf clubs 40 would be inserted in the central opening 10. Because the wood type golf clubs 40 are longer than the iron type golf clubs 38, the heads of the wood type golf clubs 40 would project several inches above the upper surface of the holder means 2 when the holder means 2 is disposed in the container means 4 in a longitudinally contracted position thereof. A longitudinal length of the holder means 2 is preferably such that a free end of a longest one of the iron type clubs 38 will extend to a lower end of the lower portion 6 and a head of the longest iron club will extend even with or slightly above the corresponding slot 20 when the holder means 2 is in its longitudinally contracted or lowered position (as discussed further hereinbelow), and such that the free ends of the shafts of all of the iron type golf clubs 38 will project slightly below the lower open end of the lower portion 6 and the heads of all of the iron club heads will rest on the corresponding slots 20 when the holder means 2 is in a raised or longitudinally extended position thereof (as discussed further hereinbelow). With such length dimension, the heads of all of the iron type clubs 38 will hang on the corresponding slots 20 when the holder means 2 is in its raised position for thereby further resisting rotating or shifting movements of the iron type golf clubs when the apparatus is being transported during a round of golf.

The septa 19, the slots 20 and the U-gaps 21 of the upper deck 18 have a sufficient depth that the head of each of the iron clubs 38 will be retained between opposing surfaces of an adjacent pair of the septa 19, will extend into the corresponding U-gap 21 when the holder means is in a lowered position thereof, and will project outwardly through the corresponding U-gap 21 when the holder means 2 is in a raised position thereof so that the head of the iron club cannot come into contact with the heads of adjacent clubs in any position of the holder means 2. The iron club heads will project slightly through the U-gaps 21 when the holder means 2 is in its raised position because the club heads pivot slightly downwardly when supported on the slots 20. Each of the slots 20 may optionally be formed more or less deeply into the upper surface of the deck 18 so as to accommodate the different lengths of the iron type golf clubs 38. For example, a slot 20 intended to accommodate the head of a longer iron club may be formed less deeply into the deck 18, while a slot 20 intended to receive the head of a shorter iron club may be formed more deeply into the deck 18 to assure that all of the clubs 38 will properly hang on the slots 20 when the holder means 2 is in a raised position thereof and with a minimum longitudinal movement of the holder means 2 to achieve the raised position.

The elastic bands 22, 24 function primarily in relation to the lowered or closed position of the holder means 2 to additionally secure the iron type clubs 38 against movement. Particularly, when the holder means 2 is in its raised position, which is most desirable when playing a round of golf as discussed further below, the bands 22, 24 will be disposed closely adjacent to the radially outer surfaces of the slots 20 so that the club heads may also rest thereon, but without interfering with the removal of or insertion of the club shafts into the openings 12. When a person has finished using the clubs during a round of golf and desires to store the clubs in the supporting apparatus, he or she will insert the club heads through the interweaved loops of the bands 22, 24 and slide the loops down over the shank of the club shafts adjacent the heads so that when the holder means 2 is moved to its closed or lowered position the club shanks are engaged by the bands 22, 24 and further restrained against movement. The head pads 26 would then be inserted into the respective openings, slots and U-gaps 12, 20, 21 for further securing the heads of the iron clubs 38 against movement when the holder means is in its lowered position and the clubs are to be stored. If desired, head covers for the iron type clubs 38 could also be provided thereover for purposes of storage. When it is desired to again use the golf clubs for a round of play the above procedure is reversed, including removal of the head pads 26, moving of the holder means 2 to the raised position, and removing the bands 22, 24 from around the club heads.

The above structure of the holder means 2 is very advantageous for many reasons. The arrangement of the smaller openings 12 for the iron clubs 38 around the central larger opening 10 for the wood type clubs 40 permits the holder means to have a desirably compact and lightweight structure. The structure of the upper deck 18 including the slots 20 and the U-gaps 21 facilitates use of the iron type clubs 38 during a round of golf because the club heads project outwardly of the U-gaps so that they may be easily gripped and removed from the holder means as desired, and yet the septa 19 prevent the club heads from coming into contact with each other. Still further, the longitudinal adjustability of the holder means 2, its open lower end and its length dimension relative to the length of iron type golf clubs further prevents movement of and rattling of the clubs during a round of golf because the club heads physically hang on and are suspended from the slots 20.

Although the holder means 2 preferably includes a structure as described above, many modifications may be made thereto. For example, although the deck 18 preferably has flat upper and lower surfaces, one or both of such surfaces may be radially sloped or stepped in structure. Further, the area of the deck 18 corresponding to the septa 19 may be foldable or hinged such that each of the septa 19 may be pivotable between a raised position in which they engage and separate the club heads from each other but do not securely retain the club heads in position, and a lowered position in which the septa 19 clip the shafts of the clubs 38 in the closed position. A hinge is shown at 19' in FIG. 2. The elastic bands 22, 24 may be omitted in this modification due to the clipping action of the septa 19.

Figure 1B:
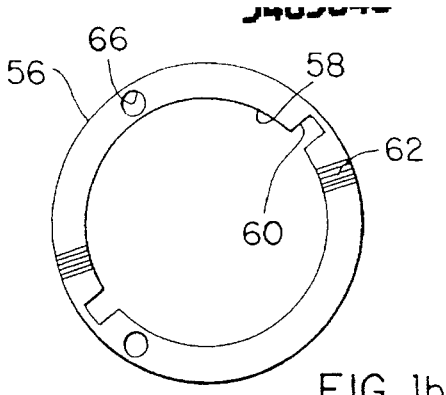
FIG. 1*b* is a top plan of a support disk of the embodiment of FIG. 1

Referring to FIGS. 1 and 1*b*, the container means 4 preferably includes an outer, substantially cylindrical, tubular member 50 having an open upper end 52 and a closed lower end 54, and a pair of ringlike disks 56 secured to inner surfaces of the tubular member 50 at intermediate portions thereof, such as one-quarter of the distance from the upper end 52 to the lower end 54 and one-quarter of the distance from the lower end 54 to the upper end 52. Each of the disks 56 has a large central opening 58 having a diameter which is slightly greater than the outer diameter of the lower portion 6 of the holder means 2 so that the rings 56 function as guides for longitudinal, up-and-down movements of the holder means 2. Each of the disks 56 has a pair of slits 60 defined therein extending radially outward from the central opening 58 and which have a planar dimension slightly greater than that of the handles 14 on the outer surface of the holder means 2 so that the handles may selectively pass through the slits when the holder means is moved between its raised and lowered positions. Additionally, each of the disks 56 preferably has a pair of grooves or recesses 62 defined in an upper surface thereof which are shaped to receive the handles 14 for selectively supporting the handles thereon. As shown in FIG. 1, the slits 60 in the upper disk 56 are preferably disposed in close proximity to the grooves 62 on the disk, whereas the slits 60 on the lower disk 56 are preferably displaced approximately at 90° from the grooves 62 on the disk; while a first pair of the handles 14 is disposed near the upper disk 56 and the other two pairs of the handles 14 are disposed near the lower disk 56. The longitudinal distance between the three pairs of handles 14 is such that the upper pair will be supported in the grooves 62 on the upper disk 56, an intermediate pair of the handles 14 is above the lower disk 56 and the bottom pair of the handles 14 is beneath the lower disk 56 when the holder means is in the raised or longitudinally extended position thereof; while the upper pair of handles will be beneath the upper disk 56, the intermediate pair of handles will be supported in the grooves 62 of the lower disk and the lower pair of handles will be further below the lower disk when the holder means is in its closed or lowered position.

The holder means 2 is freely disposed in the container means 4 such that it may move longitudinally and rotationally relative thereto. When raising the holder means to its open position from its lowered position, the holder means is rotated such that the upper pair of handles 14 is aligned with the slits 60 in the upper disk 56, the holder means 2 is then raised such that the upper handles pass through the slits 60 in the upper disk and then the holder means is again rotated so that the upper pair of handles comes to rest in the grooves 62 on the upper disk. Such process is reversed when the holder means is moved to its lowered position except, of course, that the intermediate pair of handles 14 is rotated to engage the grooves 62 in the lower disk. The slits 60 in the lower disk and the lowest pair of handles 14 are preferably only used when the holder means is to be completely removed from the container means 4. If desired, however, the lowest pair of handles could be supported on the grooves 62 in the lower disk 56 to achieve a second raised position of the holder means 2 higher than the raised position achieved when the upper pair of handles 14 is supported on the grooves of the upper disk 56. Such second raised position may be desirable if the apparatus is to be used with different sets of iron type golf clubs having different lengths. Similarly, the grooves 62 of the upper and/or lower disks may optionally be padded to increase the elevation of the holder means 2 in its raised or lowered positions by any small amount that may be needed or desired.

In the above embodiment the holder means 2 is supported above the bottom surface 54 of the container means when the holder means is in the lowered or closed position thereof. Such structure could be modified by eliminating the middle pair of handles 14 and permitting the holder means to rest on the bottom surface 54 of the container means in the closed position thereof. Further, the lower pair of handles 14 and the slits 60 in the lower disk 56 may be omitted; and the grooves 62 of both of the disks 56 may be omitted so that the handles 14 simply rest on upper surfaces of the disks 56.

Figure 1A:
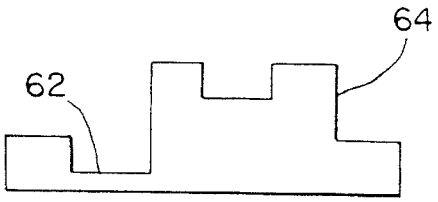
FIG. 1*a* is an elevational view of a modification of a section of a support ring in the structure of FIG. 1.

Referring to FIG. 1*a*, which is an elevational view of a section of a modified disk 56' looking from the central opening 58 outwardly, the upper disk 56' could have a pair of grooved projections 64 (only one projection is shown in FIG. 1*a*), provided thereon adjacent to the grooves 62, respectively, so that two different raised positions of the holder means 2 could be selectively achieved by supporting the upper handles 14 of the holder means in either the grooves 62 or in the grooves of the projections 64. Alternatively, a pair of grooved blocks, not shown but having a shape similar to the grooved projections 64, may be supported on the upper disk 56 to achieve the same function as the projections 64. Additionally, the slits 60 of the upper disk 56 may be disposed less closely adjacent to the grooves 62, for example spaced 90° from the grooves, but the holder means 2 would have to be rotated to a larger extent for moving it to a raised or lowered position thereof.

Figure 1C:
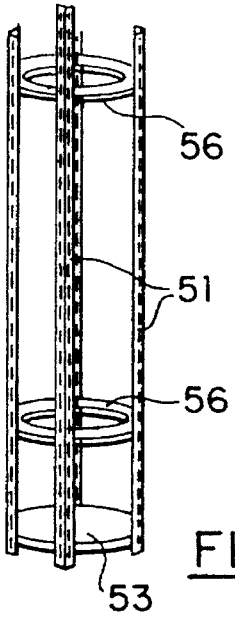
FIG. 1*c* is a front elevational view of a modification of a container means portion of the embodiment of FIG. 1.

Further yet, the outer cylindrical tubular member 50 of the container means may be replaced by other appropriate supporting structure for the disks 56. For example, and as shown in FIG. 1*c*, a plurality of longitudinally extending support shafts or rods 51, such as two or four shafts disposed in uniformly spaced positions about circumferential portions of the disks, could be used to connect the disks 56 in an appropriate spaced relationship. Additionally the modified container means would preferably include a lower support plate 53 secured to the lower ends of the shafts 51. Such rods 51 and plate 53 would desirably be less bulky and more lightweight than a tubular member 50 and would permit ready access to a space (discussed further below) defined outwardly of the holder means 2 above and below the disks 56 for storing various articles such as golf balls, etc. Similarly, the disks 56 could be directly fixed to an inner surface of a golf bag, such as the bag 70, 70' shown in FIGS. 4, 6 and 10.

As shown in FIG. 1 there is a space defined between the outer surface of a lower portion 6 of the holder means 2 and the inner surface of the tubular member 50 of the container means 4 above and below the disks 56. Such space may be advantageously utilized for storing additional articles such as golf clubs, umbrellas, towels, golf balls, etc. For purposes of storing umbrellas, additional golf clubs or other elongate members, the disks 56 have openings 66 defined therethrough, and which are sufficiently sized to permit passage of the handles of golf clubs, folded umbrellas, or the like therethrough. The size of the storage space is largely determined by the difference in diameters of the tubular member 50 of the container means and the lower portion 6 of the holder means. If a modified container means is used having support shafts or only disks, access to space is facilitated.

Figure 10:
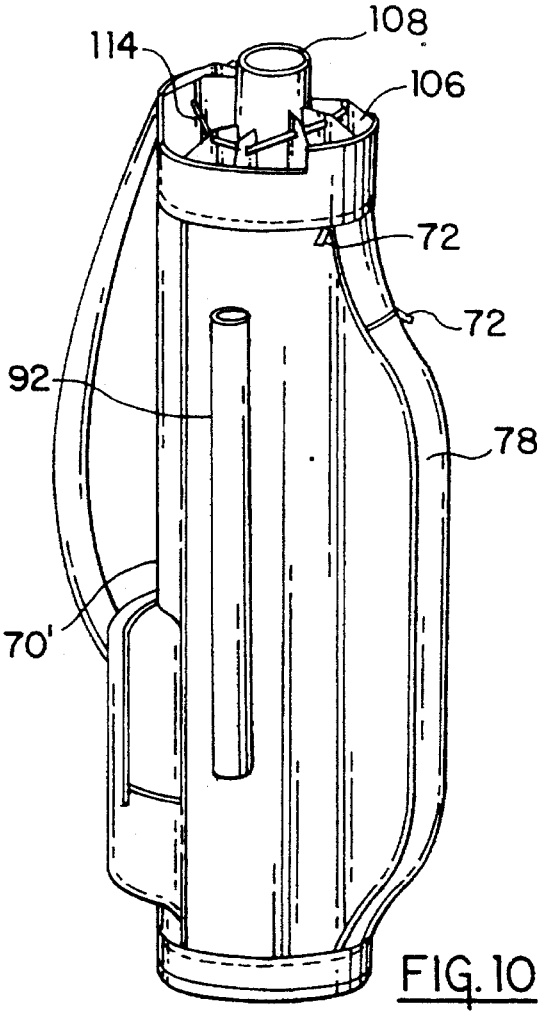
FIG. 10 is an elevation view of a golf bag having the supporting means of the FIG. 7 embodiment disposed therein.
Figure 4:
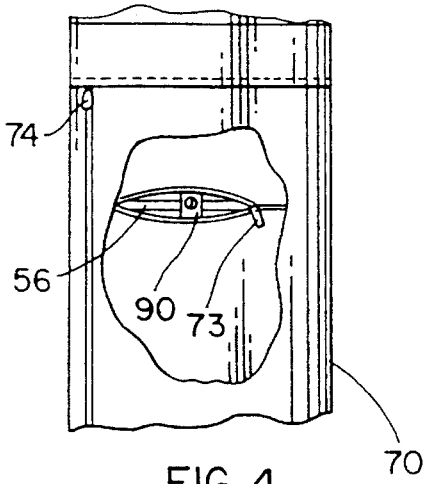
FIG. 4 is a side elevational view of an upper half portion of an outer bag structure which may be used with the club supporting structure according to either embodiment of the invention, partially broken away to reveal internal fastening structure.
Figure 6:
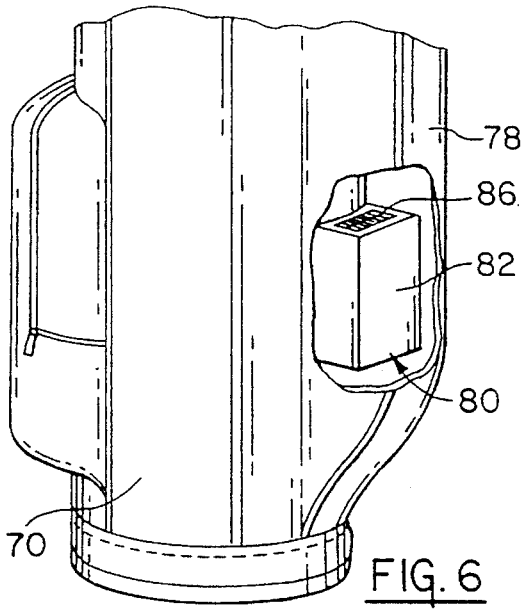
FIG. 6 is a side elevational view of a lower half portion of the bag of FIG. 4, partially broken away to reveal the washer unit structure disposed therein.

The container means 4 together with the holder means 2 may be conveniently transported by disposing the container means in a golf bag 70 such as shown in FIGS. 4 and 6 in relation to a first embodiment of the invention or a bag 70' such as shown in FIG. 10 in relation to a second embodiment of the invention, which has the appearance of a conventional golf bag, but preferably includes structure for securing the container means 4 therein and for permitting access to the storage space between the holder means 2 and the container means 4. For example, large zippered openings 72, 73, 74 may be provided in the bag 70 to permit access to the storage space and to fastening clips 90 which may be selectively attached to the container disks 56 for securing same within the bag 70.

Figure 5:
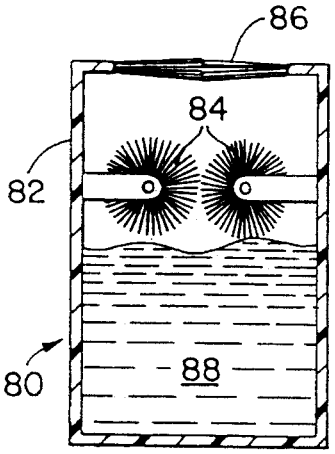
FIG. 5 is a cross sectional view of a removable washer unit structure.

According to a preferred aspect of the invention, the apparatus will also include a club washer unit 80 such as shown in FIGS. 5 and 6, and which would preferably be disposed partially within the storage space defined between the container means 4 and the holder means 2 and accessible through a zipper pocket of the golf bag 70 such as the pocket 78 as shown in FIGS. 6 and 10. Referring to FIGS. 5 and 6, the club washer unit will preferably include an enclosed receptacle 82 having a pair of stiff, rotatable brushes 84 disposed within an upper portion thereof and a flexible gate 86 provided on the upper surface thereof. In use a cleaning solution 88 would be introduced into the receptacle 82 so as to fill a lower portion thereof, while a club head would be inserted through the flexible gate 86 and reciprocally moved between the stiff brushes 84 and the cleaning solution 88 so as to clean same. The upper flexible gate 86, which may for example be constructed of two rows of flexible, resilient teeth formed of plastic or the like, is normally in a closed position thereof so as to prevent the cleaning solution 88 from splashing out of the receptacle 82, but permits a golf club to be easily inserted therethrough and into the receptacle. The unit 80 may be appropriately supported by the container means 4 by securing a bottom surface of the unit 80 on one of the disks 56 or on the bottom surface 54 of the container with an appropriate fastening means, and the unit 80 will preferably be a portable, removable unit so that it may easily be secured to the container means 4 for use during a round of golf, and can be easily removed therefrom once the round of golf is finished. Most preferably, the unit 80 will be accessible through the pocket 78 of the golf bag 70 so that it can easily be connected to or disconnected from the container means by opening a zipper 72 or other appropriate closure means on the pocket 78 and appropriately inserting or removing the unit. Similarly, golf clubs may be easily inserted into the unit 80 for washing by opening the zipper 72 to expose the unit 80. Preferably the unit 80 will have a larger width than the space between the lower portion 6 of the holder means 2 and the tubular member 50 of the container means 4 so that the unit 80 will project into the pocket 78. An appropriately sized opening would be formed in the tubular member 50 to permit the unit 80 to be selectively secured to the lower disk 56 or to the bottom of the container means.

Figure 7:
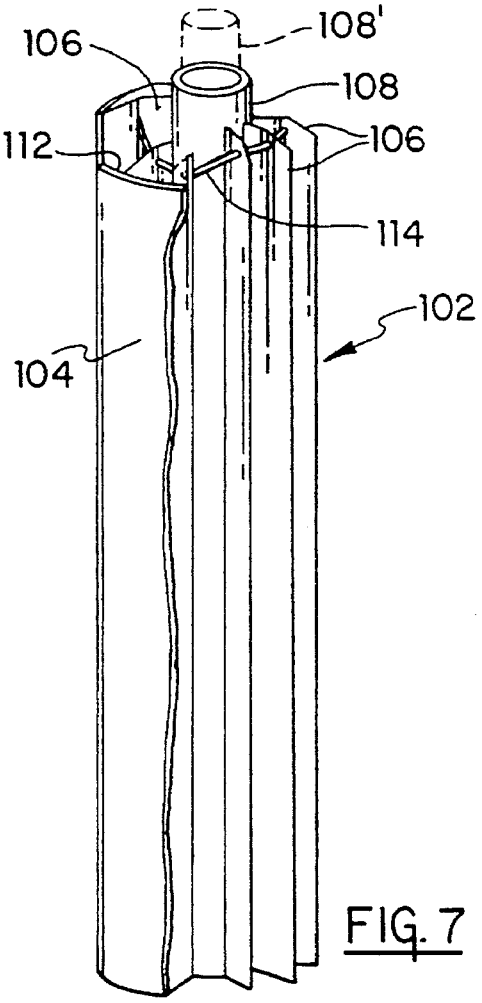
FIG. 7 is a front elevational view of a second embodiment of a holder portion of the invention partly broken away to reveal internal structure.
Figure 8:
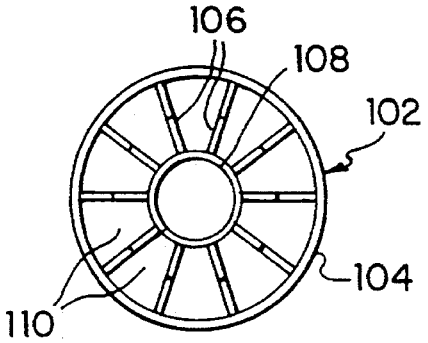
FIG. 8 is a top plan view of FIG. 7.

Referring to FIGS. 7 and 8 there is shown a second preferred embodiment of the present invention in which FIG. 7 is a front elevational view of a holder means 102 partly broken away to reveal internal structure, and FIG. 8 is a top plan view of the holder means 102.

As understood from FIGS. 7 and 8, a primary difference between the first and second embodiments is the structure of the holder means 102. The container means according to the second embodiment will have substantially the same structure as the container means 4 according to the first embodiment, and accordingly the container means is not shown in FIGS. 7 and 8 and the description thereof will not be repeated hereinbelow.

The holder means 102 according to the second embodiment primarily includes an outer substantially cylindrical member 104, a plurality of vanes 106 and an inner substantially cylindrical member 108 which cooperate to define a plurality of storage compartments 110 (ten compartments in the depicted embodiment). The vanes 106 are preferably longer than the outer cylindrical member 104 such that they project from the upper end thereof, while the inner cylindrical member is preferably longer than the vanes such that the inner member 108 projects above the other components. Each of the components 104, 106, 108 is preferably formed from a lightweight material such as plastic, aluminum or the like; and it is preferred that at least the vanes 106 and the outer member 104 will be integrally formed as a unitary member through molding or the like. The inner cylindrical member 108 may additionally or alternatively be formed integrally with the vanes 106, but it is preferred that the inner member 108 be formed separately and simply inserted between the vanes 106 such that the inner member 108 is longitudinally movable with respect to the vanes 106 and vice versa.

Alternatively, the upper end of inner member 108 could be formed as a telescopic arrangement such as indicated in FIG. 7 by the member 108' in broken lines extending from the upper end of member 108. The telescopic arrangement is preferably selectively adjustable between several positions, including a fully contracted position in which upper ends of the members 108, 108' would both be disposed below upper ends of the vanes 106, a fully extended position in which the upper end of member 108' would project several inches above the upper end of member 108, and an intermediate position in which the upper end of member 108 is below the upper ends of vanes 106 and the upper end of member 108' is even with the upper ends of vanes 106. The fully contracted position is desirable because the heads of iron type clubs may project slightly inwardly of inner ends of vanes 106 during storage if necessary to prevent the club heads from projecting outwardly of outer member 104, and to provide space for accommodating head covers for wood type golf clubs which may extend down below the upper ends of vanes 106. The telescopic arrangement would also include appropriate means (not shown) for maintaining the members 108, 108' in selected positions thereof.

The compartments 110 are for storing iron type golf clubs therein similar to the smaller openings 12 and upper deck structure 18 of the first embodiment, while the inner cylindrical member 108 is for storing the shafts of a plurality of wood type golf club shafts therein similar to the central opening 10 of the first embodiment. Ringlike hooks similar to the hooks 36 of the first embodiment could be provided on the inner surface of inner member 108.

Although not shown, the outer cylindrical member 104 of the holder means 102 will have at least one pair of handles, such as the handles 14 of the first embodiment, provided on an outer surface thereof for cooperating with the container means to achieve the multiple longitudinally displaced positions of the holder means 102 relative to the container means. The handles could be formed integrally with the outer member 104 or attached thereto with appropriate fastening means.

As shown in FIG. 7 the outer cylindrical member 104 preferably has a stepped upper surface 112 and the vanes 106 have different lengths corresponding to the stepped upper surface 112 of the outer cylindrical member. Through such stepped structures smaller iron type clubs may be disposed in storage compartments 110 defined by shorter vanes 106 and longer iron type clubs can be disposed in compartments 110 corresponding to the longer vanes 106 so that the holder means 102 may be moved a relatively short distance between the raised and lowered positions thereof, while otherwise assuring that each of the clubs will be properly suspended from the holder means when it is in a raised position thereof.

The holder means 102 also preferably comprises a cord member 114 extending through openings defined in the vanes 106 near upper ends thereof. The cord 114 is adapted to engage surfaces of each of the iron club heads near the shanks thereof such that the club heads will hang from the cord 114 when the holder means 102 is in a raised position thereof. If the cord 114 is omitted, the iron club heads will hang on the stepped upper surface 112 of the outer member 104. As depicted the lower end of the holder means 102 is open similar to the holder means 2 of the first embodiment so that the free ends of the club shafts will project through the open end of the holder means when it is in a raised position thereof to, again, additionally secure the iron clubs (as suspended on the cord 114 or the upper surface 112) against movement thereof when the holder means is in its raised position.

The inner cylindrical member 108 is preferably longitudinally movable relative to the vanes 106, as discussed above, and its upper end will project above the upper ends of the vanes 106 when its lower end is disposed adjacent lower ends of vanes 106. The distance that the inner member 108 projects above the vanes 106 will be as large as or slightly larger than the distance which the outer member 104 and vanes 106 move when they are extended from a lowered position thereof to a raised position thereof in the container means, so that the inner member 108 and the wood clubs stored therein will not interfere with the normal movements of the holder means 102.

Figure 9:
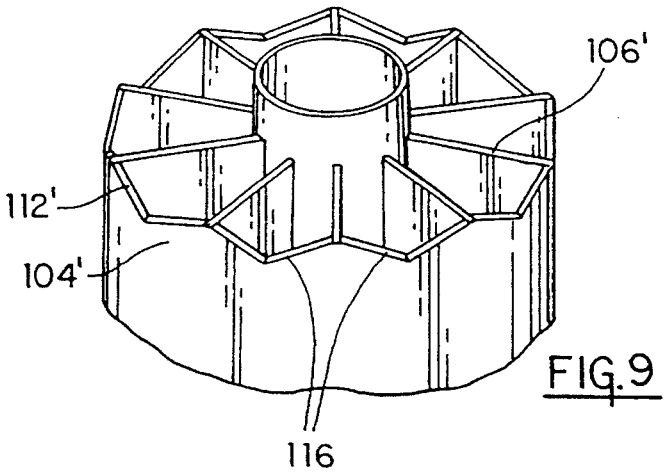
FIG. 9 is a perspective view of an upper end of a modification of the embodiment of FIG. 7.

Although the above structure of the holder means 102 is preferred, many modifications are possible thereto, including the telescopic arrangement including member 108'. With reference to FIG. 9, for example, the vanes 106' may not project above the upper surface 112' of the outer member 104', but instead may have the same height as the upper surface 112'. With such modification the upper surface 112' of the outer member 104' would preferably have deep recesses or slots 116 defined therein such as shown in FIG. 9, the recesses 116 permitting the free ends of the club heads to project outwardly of the outer member 104' when the holder means 102' is in a raised position thereof. Further, the upper surface 112' of the outer member 104' may not be stepped, but instead have a uniform height, except for the slots 116, as also shown in FIG. 9. If both of the modifications shown in FIG. 9 are utilized so that the upper surface 112' is not stepped and the vanes 106' do not project above the upper end 112', the cord 114 may be omitted and the club heads will hang from the surfaces of the slots 116 when the modified holder means 102' is in a raised position thereof. Although not shown, the slots 116 may be formed with varying depths into the upper surface 112' so that the slots 116 may better accommodate the different lengths of the clubs and the holder means 102' will require a smaller longitudinal movement when being adjusted from its lowered position to its raised position similar to the stepped structure of the holder means 102 shown in FIG. 7.

Another modification of the holder means 102 would be the omission of the outer cylindrical member 104, in which case the holder means comprising the vanes 106 and the inner cylindrical member 108 would be inserted directly in the container means and appropriate handle members would be appropriately secured to the vanes 106 directly.

Referring to FIG. 10, there is shown a golf bag 70' having a supporting means 102 according to the second embodiment disposed therein. The bag 70' has substantially the same structure as the bag 70 of FIGS. 4 and 6, except that the upper end of bag 70' is preferably stepped in a shape corresponding to the stepped upper end of the holder means 102. Tube 92 shown in FIG. 10 is an auxiliary receptacle for temporarily holding a golf club. The tube 92 is attached to an outer surface of the bag 70' and is adapted to receive the shaft of a club such as hastily thrown by a user, in anger or otherwise, after which the club may be moved to one of the openings 10 or 12..

Although there have been described what are at present considered to be the preferred embodiments of the invention, it will be understood that the invention can be embodied in other specific forms without departing from the spirit or essential characteristics thereof. For example, the relative movement between the holder means 2 and the container means 4 may not be achieved manually through rotation and lifting of the holder means as described above, but may instead use an external lever in conjunction with pulleys, gears or other levers.

The present invention is therefore to be considered in all aspects as illustrative, and not restrictive. The scope of the invention is indicated by the appended claims rather than by the foregoing description.

I claim:

1. Apparatus for supporting golf clubs, comprising:

holder means having a plurality of separate storage compartments defined therein for receiving a plurality of golf clubs, respectively, each said storage compartment being adapted to isolate a golf club received therein from contact with other golf clubs received in other said storage compartments, and each said storage compartment having a lower portion for receiving a shaft of one of the golf clubs and an upper portion for receiving a head of the one golf club; and container means for containing and supporting the holder means in multiple, longitudinally separate positions of the holder means, said holder means being movable with respect to said container means.

2. Apparatus according to claim 1, wherein each of said upper portions of said storage compartments include means for supporting the heads of the golf clubs, respectively, thereon when said holder means is moved to an elongated position thereof.

3. Apparatus according to claim 2, wherein said support means of said upper portions comprises recesses formed in outer circumferential surfaces of said upper portions, respectively.

4. Apparatus according to claim 2, wherein said support means of said upper portions comprises a cord extending near outer circumferential surfaces of said upper portions, respectively.

5. Apparatus according to claim 1, wherein said upper portions of said storage compartments have a relatively narrow width such that free ends of the golf club heads will project laterally outwardly of outer circumferential surfaces of said upper portions when the golf clubs are supported in said storage compartments.

6. Apparatus according to claim 1, further comprising an outer bag adapted to securely receive said container means therein, a storage space being defined between surfaces of said holder means and said container means, and said outer bag having means having closable openings therein for selectively accessing said storage space.

7. Apparatus according to claim 1, wherein said holder means further includes a receptacle disposed inwardly of said storage compartments, said storage receptacle being adapted to receive the shafts of a plurality of golf clubs therein.

8. Apparatus according to claim 7, wherein said holder means is formed as an integral unitary member having a plurality of openings defined longitudinally therethrough and corresponding to said storage compartments and said storage receptacles, respectively.

9. Apparatus according to claim 1, wherein said holder means comprises a substantially cylindrical member and a plurality of vanes extending radially from said substantially cylindrical member so as to define said storage compartments therebetween.

10. Apparatus according to claim 9, wherein said substantially cylindrical member and said vanes are molded integrally as a unitary member.

11. Apparatus according to claim 1, wherein said holder means comprises a substantially cylindrical member, a plurality of vanes operatively associated with an outer surface of said substantially cylindrical member and extending parallel to a longitudinal axis of the substantially cylindrical member such that the vanes project radially outwardly from the substantially cylindrical member and such that said separate storage compartments are defined between adjacent pairs of said vanes, respectively, and means operatively cooperating with ends of said vanes to support golf club heads therefrom when handles of the golf clubs are disposed between adjacent pairs of the vanes.

12. Apparatus according to claim 9, wherein said vanes extend inwardly from said substantially cylindrical member; and said storage compartments have different longitudinal lengths and are arranged such that upper portions thereof extend in a stepped manner about the circumference of said substantially cylindrical member so as to accommodate different sized golf clubs.

13. Apparatus according to claim 9, wherein said vanes extend radially inwardly from said substantially cylindrical member; and said holder means further comprises a second substantially cylindrical member disposed inwardly of inner ends of said vanes and defining inner surfaces of said storage compartments.

14. Apparatus according to claim 13, wherein said vanes are connected to each other through said substantially cylindrical member disposed outwardly thereof, said vanes are movable relative to said second substantially cylindrical member along a longitudinal axis of said second substantially cylindrical member; and an upper portion of said second substantially cylindrical member is telescopically extendable between an expanded position and a contracted position.

15. Apparatus according to claim 7, wherein said storage compartments are adapted to securely store iron type golf clubs therein, and said storage receptacle is adapted to receive shafts of a plurality of wood type golf clubs therein.

16. Apparatus according to claim 1, wherein said holder means comprises a substantially cylindrical member having a plurality of elongate openings formed longitudinally therethrough in a uniformly spaced manner about a circumferential portion thereof so as to define said lower portions of said storage compartments, respectively, and a deck projecting outwardly from an upper end of said substantially cylindrical member and having a plurality of recesses formed therein to define said upper portions of said storage compartments, respectively.

17. Apparatus according to claim 1, wherein said container means comprises a plurality of support rings, means for connecting the support rings together in a longitudinally spaced manner along a common axis of the support rings, and each of said support rings having a large central opening defined therein which is shaped to permit said holder means to pass therethrough;

said holder means having handle members provided on said outer circumferential surface thereof;

means for selectively supporting said handle members in an elevated position above at least one of said support rings; and said holder means is longitudinally and rotatably movable with respect to said container means such that said handle members can be selectively aligned with one of said support means and a surface of said at least one support ring depending on a rotated orientation thereof for selectively disposing said holder means in said longitudinally separate positions thereof.

18. Apparatus according to claim 1 further comprising a club head washer receptable and means for selectively securing said club head washer receptacle to said container means outwardly of said holder means.

19. Apparatus according to claim 6, wherein said outer bag has an auxiliary storage receptacle provided on an outer surface thereof for receiving and temporarily storing a shaft of a golf club therein.

* * * * *